US005205245A

United States Patent [19]

Flack et al.

[11] Patent Number: 5,205,245

[45] Date of Patent: Apr. 27, 1993

[54] TWO STROKE ENGINES

[75] Inventors: Robert Flack, Ballyclare; David Thornhill, Belfast, both of Northern Ireland

[73] Assignee: Jaguar Cars Limited, United Kingdom

[21] Appl. No.: 707,642

[22] Filed: May 30, 1991

[30] Foreign Application Priority Data

Jun. 2, 1990 [GB] United Kingdom ..... 9012349

[51] Int. Cl.[5] ..... F02B 33/04

[52] U.S. Cl. ..... 123/65 P; 123/59 AL; 123/190.1

[58] Field of Search ..... 123/65 A, 65 P, 190.1, 123/190.2, 81 B, 81 C, 59 AL, 73 PP, 65 V

[56] References Cited

U.S. PATENT DOCUMENTS 1,632,988 6/1927 Adams .
2,110,754 3/1938 Alston ..... 123/65 A
2,145,415 1/1939 Bokemuller .
4,736,716 4/1988 Ohyama ..... 123/65 A
5,072,699 12/1991 Pien ..... 123/65 P

FOREIGN PATENT DOCUMENTS 932639 9/1955 Fed. Rep. of Germany .
2467288 5/1981 France ..... 123/190.2
9102144 2/1991 PCT Int'l Appl. ..... 123/190.2

*Primary Examiner*—David A. Okonsky
*Attorney, Agent, or Firm*—Davis, Bujold & Streck

[57] ABSTRACT

A two stroke internal combustion engine includes a cylinder with a piston slidably sealed in the cylinder, a plurality of transfer ports open into the cylinder and at least one exhaust port leads from the cylinder, the transfer ports are connected to a common inlet manifold and a common valve member is provided to regulate the flow of air from the inlet manifold to the transfer ports and to vary the flow of air through one transfer port relative to the flow of air through at least one other transfer port.

9 Claims, 3 Drawing Sheets

TWO STROKE ENGINES

BACKGROUND TO THE INVENTION

The present invention relates to two stroke internal combustion engines.

In conventional two stroke internal combustion engines, the or each cylinder is provided with a series of transfer ports, typically from three to six, through which air or air/fuel mixture may be pumped to sweep the combustion products from the combustion chamber. In engines produced hitherto, the transfer ports are arranged such as to maximise the proportion of combustion products swept from the combustion chamber thus producing maximum power. However; particularly at part load, the flow of scavenging air may be short circuited, so that not all the combustion products will be swept from the combustion chamber, with consequent reduction in fuel efficiency and engine smoothness. Other adverse effects would include increased emission of noxious substances or excessive cooling of exhaust gases.

The present invention provides valve means by which various combinations of the transfer ports may be closed or partially closed to modify the flow of scavenging air under particular operating conditions, thereby reducing short circuiting of the air flow and improving sweeping of the combustion products from the combustion chamber.

SUMMARY OF THE INVENTION

According to one aspect of the present invention a two stroke internal combustion engine comprises a cylinder with a piston slidably sealed in the cylinder, the cylinder including a plurality of transfer ports and at least one exhaust port, each transfer port being connected to a common inlet manifold, a common valve means being provided to selectively regulate flow of air from the inlet manifold to each transfer port and to vary the rate of flow of air through one transfer port relative to the flow of air through at least one other transfer port.

The valve means of the present invention may be used to adjust the scavenging flow characteristics with changing load and speed requirements, to ensure that air utilisation is maintained and consequently emissions, fuel consumption and the misfire are minimised.

According to a preferred embodiment of the present invention, the valve mechanism comprises a cylindrical sleeve which is located in a manifold, the cylindrical sleeve has ports machined at appropriate positions corresponding to ducts which separately connect each of the transfer ports to the manifold. The cylindrical sleeve may be rotated and/or moved axially in the manifold, to align the ports with different ducts, thereby opening or closing the transfer ports as required.

BRIEF DESCRIPTION OF THE DRAWINGS

An embodiment of the invention is now described, by way of example only, with reference to the accompanying drawings, in which.

DESCRIPTION OF A PREFERRED EMBODIMENT

Figure 1:
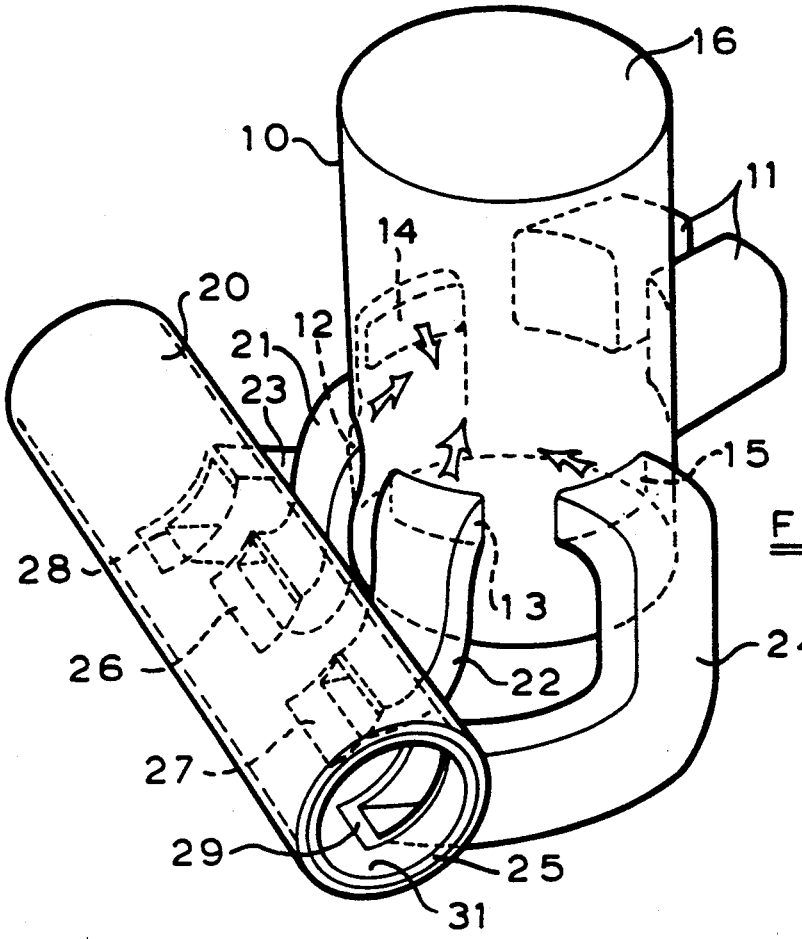
FIG. 1 is an isometric view of a cylinder of an internal combustion engine formed in accordance with the present invention.
Figure 2:
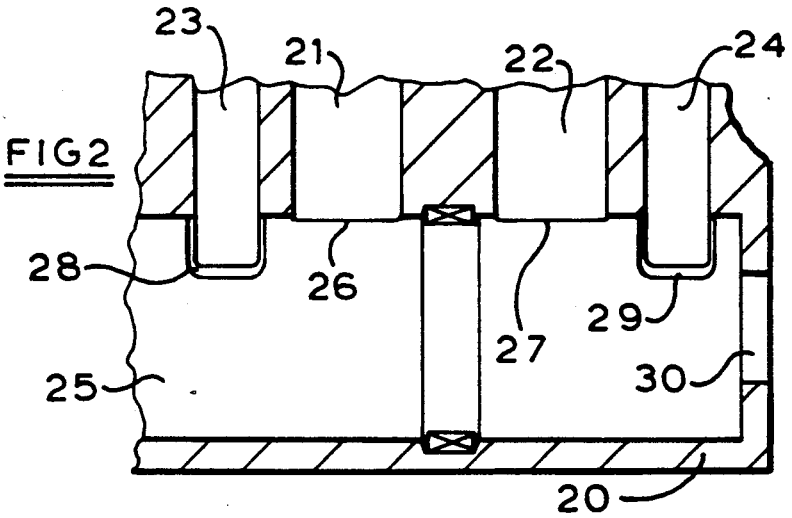
FIG. 2 is a part sectional view of the valve mechanism used in the internal combustion engine shown in FIG. 1.

As illustrated in FIG. 1, an internal combustion engine includes a cylinder 10 having a piston (not shown) slidably sealed therein. A pair of exhaust ports 11 are disposed side by side and a series of transfer ports 12 to 15 are spaced angularly of one another and of the exhaust ports 11 around the circumference of the cylinder 10. The exhaust ports 11 and transfer ports 12 to 15 open into the cylinder 10 at a position spaced axially from the top 16 of the cylinder 10, at a level which will be uncovered by the piston as it approaches the bottom of its stroke. The transfer ports 12 to 15 are orientated relative to the cylinder 10 to direct flow of air in different directions, transfer ports 12 and 13 directing the flow of air generally radially but upwardly into the cylinder 10, while transfer ports 14 and 15 direct the flow of air generally in the transverse plane of the cylinder 10, but away from the exhaust ports 11. In this manner, if air is injected through all the transfer ports 12 to 15 the whole volume of the cylinder 10 will be swept.

The transfer ports 12 to 15 are connected to a common cylindrical manifold 20 by ducts 21 to 24. A cylindrical sleeve 25 is rotatably mounted in bearings in the cylindrical manifold 20, the outer diameter of sleeve 25 sealingly engaging the inner diameter of cylindrical manifold 20. The sleeve 25 has a series of circumferential ports 26 to 29, each corresponding axially to one of the ducts 21 to 24. The orientation and extent of the ports 26 to 29 vary, so that by rotating the cylindrical sleeve 25 various combinations of the ducts 21 to 24 may be opened, closed or partially interrupted, so that the flow of scavenging air into the cylinder 10 may be modified. The central bore 31 of the sleeve 25 is connected to a pressurised air supply, for example an engine driven pump, by for example an axial port 30.

Means (not shown), for example a stepping motor controlled by an electronic engine management system, is provided to rotate the sleeve 25 in accordance with engine speed, engine load and/or some other characteristic of the engine, to control flow through the various ducts 21 to 24 and hence the transfer ports 12 to 15, to optimise scavenging of the cylinder 10 for various operating conditions. Rather than using a stepping motor which may provide continuous variation of the valve mechanism, the sleeve 25 may be arranged to function in two or more discreet positions and may be moved from one position to the other by, for example, a solenoid actuator. Alternatively, movement of the sleeve 25 may be controlled by a cam operated mechanism or servomotor. Other means of controlling the valve include mechanical devices, power racks, compressed air, vacuum or thermal devices or any other engine management system.

In an alternative embodiment, the sleeve 25 may be arranged so that it is adapted to move axially of the manifold 20, the ports 26 to 29 being arranged to control flow through the ducts 21 to 24 by axial or axial and rotational movement of the sleeve 25.

Figure 3:
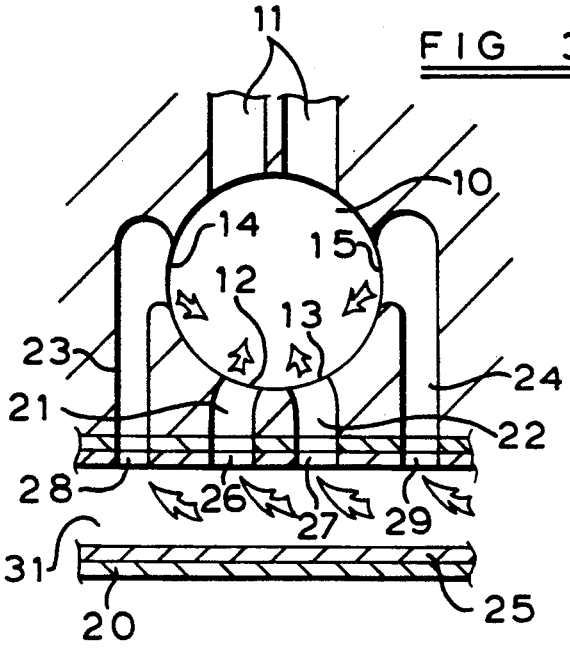
FIGS. 3 to 6 illustrate various porting configurations of the internal combustion engine illustrated in FIG. 1.

At full engine loads, the sleeve 25 may be arranged such that ports 26 to 29 are each aligned with their associated duct 21 to 24 so that all the transfer ports 12 to 15 are open, as illustrated in FIG. 3. When the piston opens the transfer ports 12 to 15, air will be injected through all the transfer ports 12 to 15, giving a conventional "loop" scavenge, which will sweep the majority of combustion products from the cylinder 10, out through exhaust ports 11.

Figure 4:
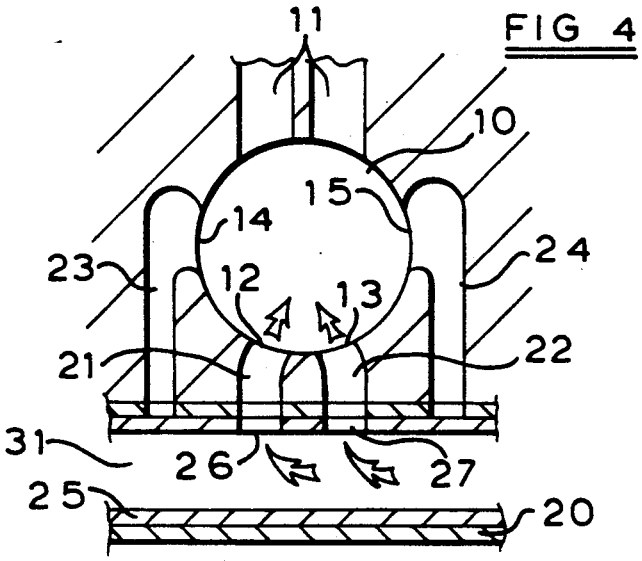

At part loads, the sleeve 25 may be arranged to close ports 14 and 15 as illustrated in FIG. 4. This will provide maximum separation between the operational transfer ports 12 and 13 and exhaust ports 11 and will reduce short circuiting of the scavenging flow, so that scavenging of the cylinder 10 will be improved.

Figure 5:
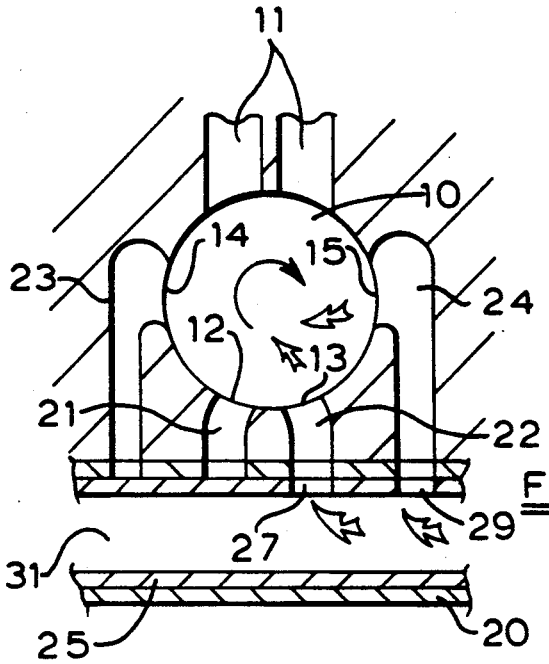

As illustrated in FIG. 5, the sleeve 25 may be arranged to close ports 12 and 14, so that the scavenging air introduced through ports 13 and 15 will swirl around the cylinder 10.

Figure 6:
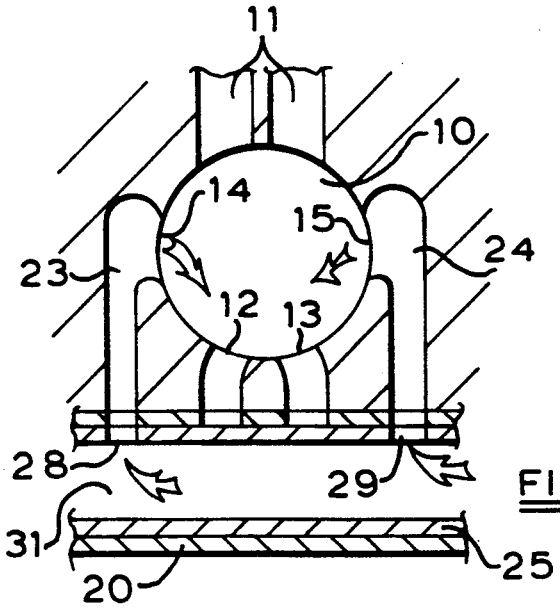

In an alternative scavenging regime illustrated in FIG. 6, ports 12 and 13 may be closed, so that flow of the scavenging air through ports 14 and 15 will be directed away from the exhaust ports 11. Reduction from four to two transfer ports, in addition to altering the flow pattern, will also increase the velocity of the air entering the cylinder 10 and hence increase adherence of the flow to the design direction.

The scavenging regimes described above are only examples, other combinations of transfer ports 12 to 15 may be used or flow through one or more of the transfer ports 12 to 15 may be only be partially interrupted, so that the scavenging flow may be optimised for a particular operating condition.

The present invention may be used on single or multi-cylinder two stroke engines. On multi-cylinder engines, the ducts 21 to 24 of each cylinder 10 may be connected to a common cylindrical manifold 20, flow through the transfer ports 12 to 15 of each cylinder 10 being controlled by a common sleeve 25.

In addition to controlling the flow of air or air/fuel mixture into the cylinders, the rotary valve described above may also control the amount of air or air/fuel mixture entering the cylinder and thus be used as a throttle in place of or in addition to a conventional throttle.

Various modifications may be made without departing from the invention. For example, instead of using the cylindrical valve means described above, flow of air or air/fuel mixture from a common manifold may be controlled by a slide plate valve which is moveable axially of the common manifold.

We claim:

1. A two stroke internal combustion engine comprising a cylinder with a piston slidably sealed in the cylinder, the cylinder including a plurality of transfer ports and at least one exhaust port, each of said transfer ports being connected to a common inlet manifold, a common valve means being provided to selectively regulate flow of air from the inlet manifold to each of said transfer ports and to vary the rate of flow of air through one of said transfer ports relative to the flow of air through at least one of said other transfer ports.

2. A two stroke internal combustion engine according to claim 1 in which each of said transfer ports is connected by a duct to the common inlet manifold, said common inlet manifold being in the form of a cylindrical manifold, the common valve means being provided by a cylindrical sleeve mounted within the cylindrical manifold, said sleeve having a series of circumferential ports, each corresponding to one of said ducts, the orientation and extent of said ports varying with respect to one another so that the ducts may be selectively opened, closed or partially interrupted by movement of the sleeve relative to the manifold.

3. A two stroke internal combustion engine according to claim 2 in which the sleeve is rotatively mounted within the manifold.

4. A two stroke internal combustion engine according to claim 2 in which the sleeve is movable axially in the manifold.

5. An internal combustion engine according to claim 2 in which a central bore of the sleeve is connected to a source of air under pressure.

6. A two stroke internal combustion engine according to claim 5 in which the bore of the sleeve is connected to an engine driven air pump.

7. An internal combustion engine according to claim 2 in which the sleeve is movable continuously relative to the manifold, by means of a stepping motor or servomotor, under the control of an electronic engine management system.

8. A two stroke internal combustion engine according to claim 2 in which the sleeve is movable from one position to another by means of a solenoid actuator.

9. A two stroke internal combustion engine according to claim 1 in which the transfer ports ar located at angularly spaced positions around the circumference of the cylinder, the transfer ports being orientated relative to the cylinder to direct flow of air in different directions.

* * * * *